US007778839B2

(12) United States Patent
Metz

(10) Patent No.: US 7,778,839 B2
(45) Date of Patent: Aug. 17, 2010

(54) METHOD AND APPARATUS FOR PROCESSING ENCODED AUDIO DATA

(75) Inventor: Rudy Hunter Metz, Durham, NC (US)

(73) Assignee: Sony Ericsson Mobile Communications AB, Lund (SE)

( * ) Notice: Subject to any disclaimer, the term of this patent is extended or adjusted under 35 U.S.C. 154(b) by 781 days.

(21) Appl. No.: 11/741,297

(22) Filed: Apr. 27, 2007

(65) Prior Publication Data

US 2008/0270143 A1 Oct. 30, 2008

(51) Int. Cl.
*G10L 21/00* (2006.01)
*G10L 19/00* (2006.01)

(52) U.S. Cl. ..... 704/500; 704/201

(58) Field of Classification Search ..... None
See application file for complete search history.

(56) References Cited

U.S. PATENT DOCUMENTS 6,421,646 B1 * 7/2002 Li ..... 704/500
6,721,710 B1 4/2004 Lueck et al.
7,342,944 B2 * 3/2008 Schroder et al. ..... 370/503
7,653,538 B2 * 1/2010 Katayama et al. ..... 704/226
2002/0027845 A1 3/2002 Sogabe et al.
2005/0197830 A1 * 9/2005 Lin ..... 704/201
2006/0265227 A1 * 11/2006 Sadamura et al. ..... 704/503

FOREIGN PATENT DOCUMENTS

EP 1587063 A2 10/2005

OTHER PUBLICATIONS

Watson et al., "Design and Implementation of AAC Decoders", IEEE Transactions on Consumer Electronics, vol. 46, Issue 3, pp. 819-824, Aug. 2000.*
"International Search Report," International Application No. PCT/US2008/052581, Jul. 16, 2008. European Patent Office, Rijswijk, Netherlands.

* cited by examiner

*Primary Examiner*—Brian L Albertalli
(74) *Attorney, Agent, or Firm*—Coats & Bennett, P.L.L.C.

(57) ABSTRACT

To locate an encoded audio frame boundary and begin decoding audio at a point corresponding to that frame boundary, an audio decoder generates a matching pattern containing a syncword and additional bits related to a header of an encoded audio frame, detects an audio frame boundary by searching a data stream of encoded audio frame for instances of the matching pattern, and begins decoding audio frames at a point in the data stream corresponding to the detected frame boundary.

22 Claims, 3 Drawing Sheets

METHOD AND APPARATUS FOR PROCESSING ENCODED AUDIO DATA

BACKGROUND

The present invention relates generally to audio decoders, such as may be used in portable music players or other multimedia devices. An audio decoder may be used to decode stored audio files, or to decode a stream of data provided over a network.

A variety of standards for encoding audio are known. In addition, a variety of standards for encapsulating encoded audio data into a data stream (which may include a data file or a stream of data provided over a network) are also known. One example of the latter is the Audio Data Transport Stream (ADTS) format, which is commonly used to encapsulate and transport audio data encoded according to the widely-used Advanced Audio Coding (AAC) standard.

ADTS and other formats organize a data stream into frames of audio data, each frame including a header. In some applications, it may be necessary to scan a portion of the data stream to find the beginning of an encoded audio frame. So-called syncwords are commonly included in frame headers to facilitate this scanning. A syncword is a fixed-length, fixed-value data field, generally placed in a consistent position within a header, such as the beginning of the header.

Although scanning a data stream to detect occurrences of the syncword is generally effective to locate frame headers, errors may occur. Because a syncword is generally limited for practical reasons to a relatively short length, such as 12 bits, an apparent syncword may occasionally appear in the audio payload data, i.e. outside a frame header. This occurrence will result in a false detection of a frame. While various techniques for recovering from such a false detection are possible, false detections result in the use of valuable processing time and cycles.

Accordingly, a method for effectively locating frame boundaries in a data stream of encoded audio frames, while reducing false detections, is needed.

SUMMARY

An audio decoder for decoding audio frames in a data stream, where each frame includes a header, is provided. The audio decoder includes one or more circuits configured to generate a matching pattern comprising a syncword and one or more additional bits corresponding to at least one anticipated value for a header field in a valid encoded audio frame; detect a frame boundary by searching a portion of the data stream for one or more instances of the matching pattern; and decode one or more audio frames beginning at a point in the data stream corresponding to the detected frame boundary.

DETAILED DESCRIPTION

The present invention provides methods for processing a data stream that includes encoded audio data, wherein the data stream is organized into frames. The methods described herein reduce false detections of frame boundaries, thus enabling improved error recovery and enhanced audio handling features in audio decoder devices. The present invention is applicable to processing of audio data organized into files and stored in non-volatile memory, or to audio data received by a network-enabled device in an audio or multimedia "stream."

Figure 1:
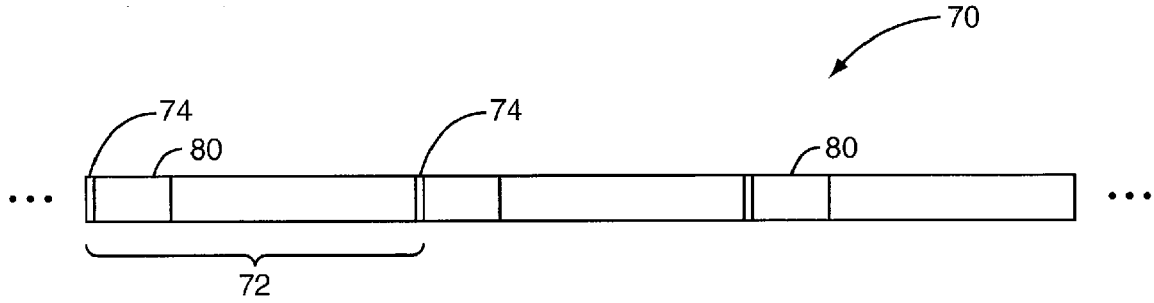
FIG. 1 PRIOR ART
FIG. 1 illustrates a data stream with encoded audio frames.

FIG. 1 illustrates a data stream 70, which includes several encoded audio frames 72. Each of the encoded audio frames 72 includes a header 80; the beginning of each header corresponds to a frame boundary 74.

A data stream 70 may include audio data encoded according to one of a variety of known audio encoding schemes, such as the MP3 (MPEG Layer 3) encoding scheme or the Advanced Audio Coding (AAC) encoding scheme. AAC has been standardized as Part 7 of the MPEG-2 standard (known formally as ISO/IEC 13818-7:1997) as well as Part 3 of the MPEG-4 standard (known formally as ISO/IEC 14496-3:1999). Those familiar with the art will recognize that a number of other audio encoding schemes already exist or may be developed in the future, and that each of these schemes may include a variety of techniques for compressing and encoding audio data. Indeed, the AAC standard itself actually includes a number of different encoding schemes, organized into "profiles" and/or "object types."

Encoded audio data, such as that encoded with AAC, typically consists of a series of data blocks. A variety of methods for encapsulating the data have been devised. Among the simplest of these methods are those intended for use in situations where the encoded audio data is organized into a file and stored in memory as a complete file. In such a situation, encapsulation of the audio may consist simply of the insertion of a single header at the beginning of the data file. This header may include data indicating the format of the audio data, as well as various other data. For example, the Audio Data Interchange Format (ADIF) is commonly used with AAC data to create AAC files. An ADIF header includes a field identifying the format of the file, as well as other data related to copyright management and to a few details specific to the audio encoding scheme used to produce the audio data.

More complex schemes for encapsulating encoded audio data have been developed to handle situations such as the transporting of audio or multimedia streams in a network environment. In a network streaming environment, such as may be found with Internet radio or in mobile communications, an audio decoder may not have access to an entire audio data file at any given time. In addition, audio data may be interwoven with other multimedia data, such as video data, for data transport purposes. To accommodate these situations, various schemes have been devised for encapsulating the audio data, wherein the audio data is organized into frames such as the encoded audio frames 72 pictured in FIG. 1. One example of such a scheme devised for use with AAC data is the Audio Data Transport Stream (ADTS) format. This format is standardized in MPEG-2 Part 7 and MPEG-4 Part 3 along with AAC. ADTS-formatted data is generally organized into a data stream 70 organized into encoded audio frames 72, with each encoded audio frame 72 including a header 80, as shown in FIG. 1.

Whether or not ADTS is used, those familiar with the art will also recognize that a data stream may include other data, for example, video data, in addition to the encoded audio. Thus, a transport scheme that uses audio data formatted as a series of encoded audio frames 72 is useful for segregating audio data from other data in the data stream 70. Accordingly, encoded audio frames 72 need not be organized into consecutive blocks. In addition, ADTS and other transport schemes using audio frames are not limited to applications involving the streaming of audio in a data network. Although a frame-based format such as ADTS uses more overhead than a simpler format, such as ADIF, these frame-based formats are nevertheless suitable for situations in which audio data is organized into files and stored in memory for retrieval and playback. Thus, the term "data stream" as used in this disclosure may refer to data organized into a file and stored in memory, or to data transported in a streaming application, such as Internet radio, in such a manner that the audio decoder may not have access to the entirety of the audio data at a given time.

Figure 2:
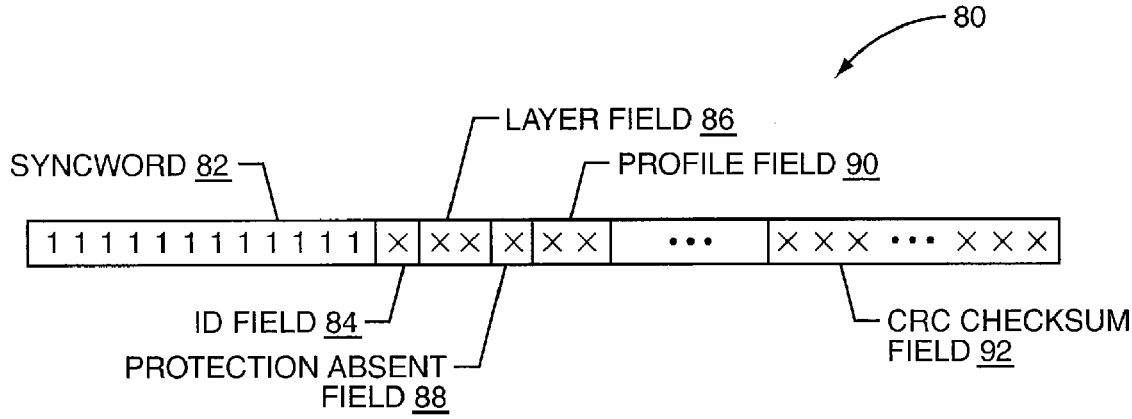
FIG. 2 PRIOR ART
FIG. 2 illustrates an exemplary header structure for an encoded audio frame.

FIG. 2 illustrates an exemplary header 80 as might be found in each encoded audio frame 72 of a data stream 70. The header 80 includes a syncword 82, which is a fixed sequence of bits used to indicate the presence of a frame header. In FIG. 2, the syncword 82 consists of a sequence of twelve "1" bits, appearing at the beginning of the frame header. The ADTS format uses a header as pictured in FIG. 2, but it should be apparent that other formats may use syncwords of different lengths, with different data, and/or appearing at different positions with the header 80. However, a consistent feature of the syncword 82 is that its structure and content is fixed with respect to a given transport format. Accordingly, every data stream formatted for ADTS, for example, will include headers 80 that each include an identical syncword 82.

In contrast, other fields within the header 80 may vary from data stream to data stream. For example, header 80 in FIG. 2 includes an ID field, which includes a single bit. This field is used in ADTS to indicate whether the audio data in the data stream 70 has been encoded according to the MPEG-2 standard (ID Field=1) or the MPEG-4 standard (ID Field=0). Thus, this field may vary between different data streams. FIG. 2 also illustrates a layer field 86, which in ADTS is fixed at "00", as well as a protection absent field 88 (in ADTS, a one-bit field indicating whether the header includes a checksum) and a profile field 90 (in ADTS, a two-bit field indicating which of several AAC encoding schemes has been used to encode the audio data). Finally, the header 80 in FIG. 2 includes a CRC (cyclical redundancy check) checksum field 92, which is optional in ADTS and may be used to verify the integrity of the header.

As should be apparent to one skilled in the art, FIG. 2 illustrates but one exemplary header structure. Various alternatives are possible, but a header 80 will typically comprise a syncword, which is a fixed value for all data streams of a given type, as well as various other fields, some of which may vary between different data streams 70 of a given type, and some that may vary between different headers 80 in a single data stream 70. For example, for ADTS, the ID field 84, layer field 86, protection absent field 88, and profile field 90 will typically be fixed within a given data stream 70, but one or more of these fields may vary from one data stream 70 to another. On the other hand, CRC field 92 may vary from one header 80 to the next. Because one or more fields may be fixed within a data stream, it may often be possible to anticipate not only the value of the syncword in any given header 80, but also the value of one or more other fields, given prior knowledge of the contents of a valid header 80.

When processing a data stream 70, it may be necessary to locate a frame boundary 74 associated with the beginning of a frame header 80. Although a data stream 70 is typically processed in a linear fashion (i.e. bit-by-bit or word-by-word), the presence of corrupted data in the data stream 70 may necessitate the identification and location of a subsequent header 80, from which location processing of the data stream 70 might continue. In addition, more complex functionality of an audio playback device may necessitate repeated identification of headers, so that one or more encoded audio frames 72 may be skipped. For example, a fast forward function may require data processing to be suspended at an arbitrary location in the data stream 70, and resumed with an encoded audio frame 72 located further along in the data stream 70. Such a function might require that encoded audio frames 72 be skipped until a terminating signal is sent. Alternatively, such a function might require that a pre-determined number of encoded audio frames 72 are skipped, and playback (i.e. decoding) resumed at the subsequent encoded audio frame 72.

Typically, a data stream 70 may be scanned sequentially, and searched for the presence of a sequence of bits matching the syncword 82. Advancing to the next encoded audio frame 72 is therefore generally a simple matter of scanning forward in the data stream 70 until a series of bits matching the syncword 82 is found, and then processing encoded audio frames 72 beginning at the location of the matching bits.

However, given a syncword 82 of any practical length, sequences of bits matching the syncword 82 may not be confined to the syncword position of headers 80. These sequences may appear at random positions within the encoded audio data. In practice, random occurrences of these sequences have been frequently observed in ADTS-formatted data, for example.

As a result, any processing of encoded audio that relies on the foregoing technique for locating frame boundaries 74 is likely to suffer from an unacceptable frequency of false detections. One method for recovering from such a false detection is to parse, upon detection of a match to the syncword, a series of data bits that should ordinarily correspond to the remainder of the header 80, and if these bits parse correctly, to proceed with processing the subsequent audio data. This parsing may include the evaluation of a CRC checksum field 92, which verifies the integrity of the header 80, and thus implicitly verifies that a valid header 80 has been located.

However, parsing an entire header 80 is time-consuming. In a processing environment where processing cycles are limited, recovering from frequent false frame boundary detections may therefore be highly undesirable, even where the frequency of false frame boundary detection is relatively low.

Figure 3:
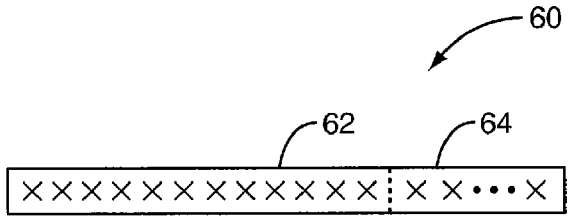
FIG. 3 illustrates an exemplary matching pattern for use in embodiments of the present invention.

FIG. 3 illustrates the structure of a matching pattern 60 that may be used in certain embodiments of the present invention. The matching pattern 60 comprises a syncword 62 which is identical to the syncword 82 found in a valid encoded audio frame 72 of the targeted data stream 70. The matching pattern 60 also comprises additional bits 64 which correspond to anticipated values for one or more fields found in headers 80 of valid encoded audio frames 72 in the data stream 70. The content of the additional data bits 64 will be discussed further below. The additional bits can be used to effectively extend the syncword. Because the frequency of false detection is directly related to the length of the syncword, an extension of the syncword reduces the frequency of a false detection.

Figure 4:
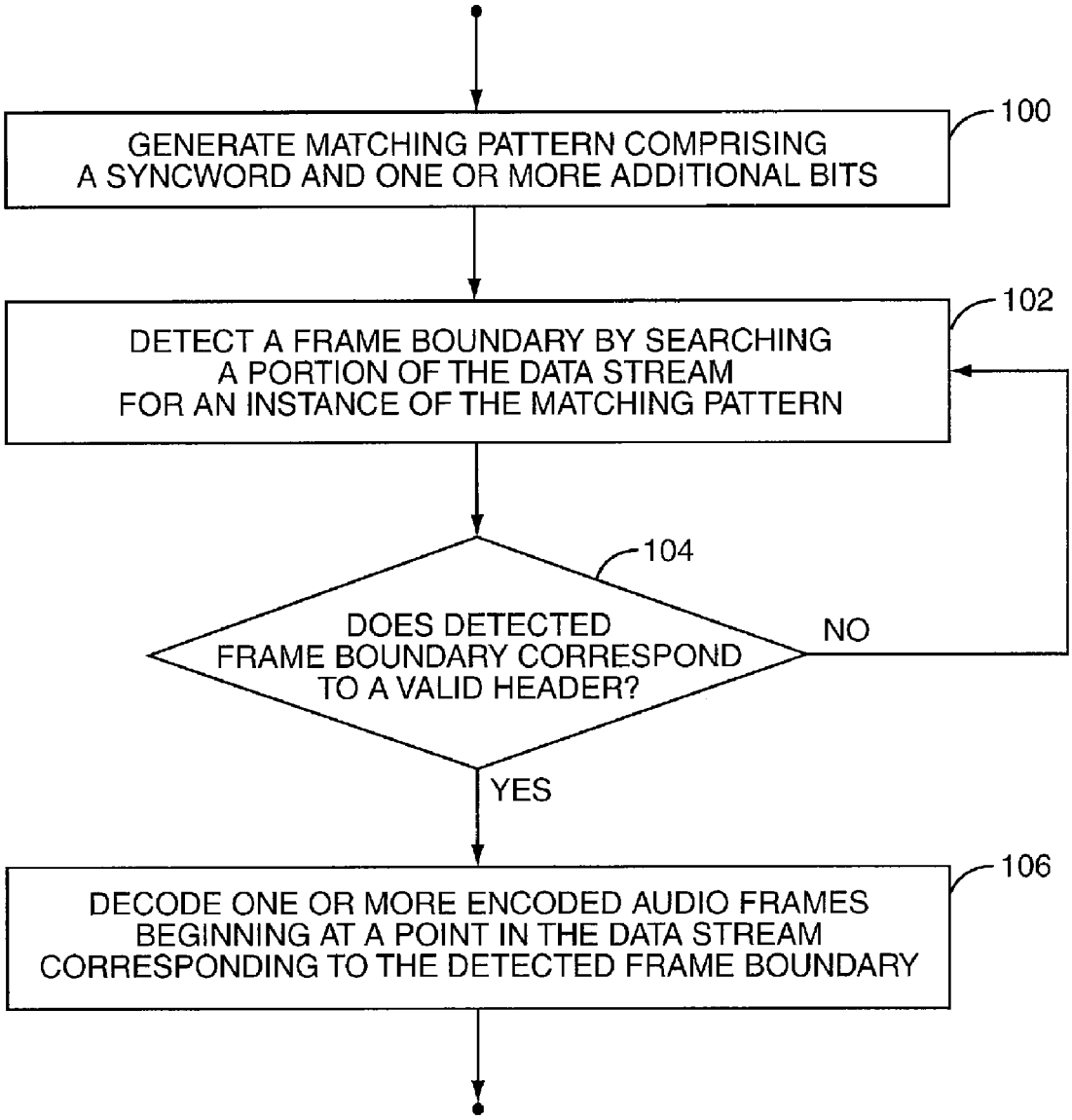
FIG. 4 illustrates an exemplary method for processing encoded audio frames.

FIG. 4 illustrates an exemplary method for processing encoded audio frames 72 in a data stream 70 in one or more embodiments of the present invention. First, a matching pattern 60 is generated (block 100), using known information corresponding to the data stream 70. In particular, the matching pattern includes a syncword 62 corresponding to the syncword 82 found in all valid headers 80 of a target data stream 70. For example, if the target data stream 70 is an ADTS-formatted data stream, then the syncword 62 will consist of a sequence of twelve 1's.

The matching pattern 60 generated in block 100 also includes one or more additional bits 64. These additional bits 64 comprise anticipated values of one or more fields found in a valid header 80 of a particular data stream 70. As discussed above, the values of certain fields of a header 80 will be fixed within a particular data stream 70, even though the values of those fields may vary between different data streams 70 of the same type. Accordingly, if the values of those fields are known for one header 80 of a given data stream 70 then those values may be anticipated to appear in all other headers 80 of that data stream 70.

Referring back to FIG. 2, it may be seen that an ADTS header, for example, includes an ID field 84, a layer field 86, a protection absent field 88, and a profile field 90. All of these fields are generally fixed within a particular data stream 70, if that data stream 70 is formatted for ADTS. In contrast, CRC checksum field 92 will vary from one ADTS-formatted header 80 to the next.

Thus, an audio decoder may generate a matching pattern 60 for use with an ADTS-formatted data stream 70 that includes a 12-bit syncword 62 and additional bits 64 that correspond to anticipated values for one or more of the ID field 84, layer field 86, protection absent field 88, and profile field 90. In this non-limiting example, the resulting matching pattern 60 is 18 bits in length. Alternatively, the matching pattern 60 might comprise a 12-bit syncword 62, plus additional bits 64 corresponding to anticipated values for only the ID field 84, layer field 86, and protection absent field 88. In this case, the matching pattern 60 is 16 bits, or two bytes, in length. This length might be more convenient in some embodiments of the present invention.

Block 100 of FIG. 4 illustrates the generation of the matching pattern 60. The matching pattern 60 may be constructed from various combinations of a syncword 62 and additional bits 64. As previously discussed, those additional bits correspond to anticipated values for one or more header fields in a valid encoded audio frame 72 contained in a particular data stream 70. The values of those header fields may be anticipated based on a priori information regarding the target data stream 70. This a priori information may have been obtained from parsing the contents of one header 80 contained in the target data stream 70, or from information separately supplied and relating to the specific target data stream 70. For example, in a streaming environment, a computer server sourcing an audio stream may provide parameters describing the audio stream separately from the data stream 70 itself. These parameters may indicate, for example, that the data stream 70 contains AAC-encoded data in accordance with the MPEG-2 standard, and that the data stream 70 does not include CRC checksum fields 92 in the headers 80. Regardless of how these parameters are formatted, it is thus possible to determine the anticipated values of several header fields contained within headers 80, without first decoding a header 80. Thus, an audio decoder may generate a matching pattern 60 using information derived from decoding a header 80, or using data derived from separately provided information.

FIG. 4 further illustrates the detection of a frame boundary 74 by searching a portion of the data stream 70 for an instance of the matching pattern 60 (block 102). This search may be conducted in a manner similar to the syncword search described above, i.e. by scanning the data stream 70 sequentially for sequences of bits that match the matching pattern 60. This might be carried out, for example, by sequentially shifting the data stream through a shift register having a length equal to the length of the matching pattern. At each cycle, the contents of the shift register may be compared to the matching pattern 60; a match would indicate the detection of a frame boundary. Alternatively, a segment of a data stream 70 might be retrieved from memory by a processor configured to compare the matching pattern 60 to each possible location in the segment, whereupon a match indicates the detection of a frame boundary. The foregoing examples are illustrative, and not intended to be limiting. Those skilled in the data processing arts will recognize that various techniques for searching a portion of the data stream 70 for an instance of the matching pattern 60 are possible.

In any event, because the matching pattern 60 is longer than the syncword 62, random matches between the matching pattern 60 and the data stream 70 are less likely than if the matching was carried out with the syncword 62 alone. Depending on how many additional bits 64 are included in the matching pattern 60, the probability of a false detection may be greatly reduced. For example, assuming that the encoded audio data is generally random, using a 16-bit matching pattern 60 will reduce the false detection rate by over 93%. In practice, of course, the improvement may vary, but the false detection rate will nevertheless be significantly reduced, even for a relatively small number of additional bits 64.

The detecting step illustrated in block 102 may optionally include searching for multiple occurrences of the matching pattern 60 in the data stream 70. In one exemplary method, a portion of the data stream 70 is sequentially searched for a pre-determined number of instances of the matching pattern 60, and the detected frame boundary 74 corresponds to the last instance. For example, an application of the method might require that five frames be skipped. In this case, the detecting step will include a search for five sequential instances of the matching pattern 60 in the data stream 70; the detected frame boundary 74 will correspond to the last of those five sequential instances.

In an alternative embodiment of the present invention, the data stream 70 may be sequentially searched for multiple instances of the matching pattern 60 until a terminating signal is received. In this embodiment, the detected frame boundary 74 may correspond to the last instance of the matching pattern 60 detected before the terminating signal was received.

In yet another embodiment of the present invention, each detection of an instance of the matching pattern 60 in the data stream 70 may trigger a signal indicating that a match has occurred, so that this signal may be used to generate a terminating signal. For example, a data stream 70 may be rapidly searched for multiple instances of the matching pattern 60. Each match may cause a signal to pulse, so that the pulses can be counted, yielding a parameter indicating the number of matches detected. A given application might require that sixty frames be skipped, for example, and thus cause the search to be continued until sixty matches have been counted, at which time the application generates a terminating signal. The detected frame boundary 74 in this example might therefore correspond to the last instance of the matching pattern 60 detected before the terminating signal was received.

After a frame boundary 74 has been detected, processing of subsequent encoded audio frames 72 may proceed. In some embodiments of the present invention, the header 80 contained in the encoded audio frame 72 corresponding to the detected frame boundary 74 may be validated before audio data is decoded, as illustrated in block 104. For example, a CRC checksum field 92 may be evaluated to confirm that the header 80 was received correctly. In the event of a false frame detection (which is less likely with embodiments of the present invention, but still possible), evaluation of the CRC checksum field 92 will almost certainly fail, indicating either that the data is corrupted or that the detection of a frame boundary 74 failed. Thus, the evaluation of a CRC checksum field 92 serves to verify that a detected frame boundary 74 corresponds to a valid header 80.

Other techniques for verifying that the detected frame boundary 74 corresponds to a valid header are also possible. For example, if the header 80 contains information indicating the length of the frame, then a processor may look ahead in the data stream to verify that a valid syncword is present where a subsequent header 80 is expected. However, it should be noted that any process for verifying that a detected frame boundary 74 corresponds to a valid header will generally require additional processing steps. Accordingly, reducing false detections in accordance with the teachings of this disclosure will also reduce the processing steps dedicated to verifying frame boundary detections.

If the detected frame header is valid, decoding of encoded audio frames 72 begins at a point in the data stream corresponding to the detected frame boundary 74, as illustrated in block 106. Decoding of the encoded audio frames 72 is carried out in accordance with the applicable encoding scheme. Thus, for example, an AAC decoder is used to decode encoded audio frames 72 encoded by an AAC encoder.

Figure 5:
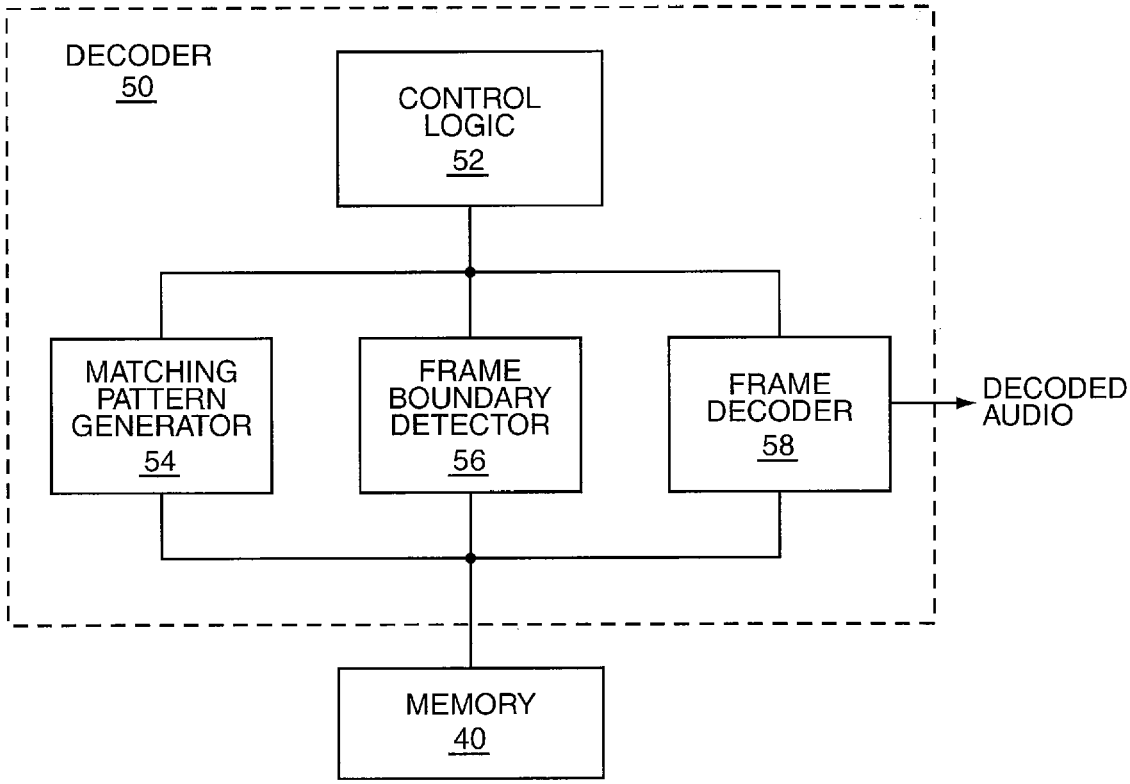
FIG. 5 is a block diagram of an exemplary audio decoder for processing audio frames.

FIG. 5 illustrates a simplified block diagram for an exemplary audio decoder according to one or more embodiments of the present invention. Decoder 50 comprises at least a control logic block 52, a matching pattern generator 54, a frame boundary detector 56, and a frame decoder 58. The decoder 50 is illustrated with an interface to a memory 40, and produces a decoded audio output.

The control logic block 52 provides overall control for the decoder 50. It may provide triggers for initiating and/or terminating audio decoding. It may also include logic for a user interface, such as a keypad or touchscreen, to allow user control of the decoder 50. Alternatively, or in addition, the control logic 52 may include an implementation of an application programming interface (API) for communication with a separate software program or program module.

The matching pattern generator 54 is configured to generate a matching pattern 60 for use with a target data stream 70, as discussed above. The matching pattern generator 54 is provided with information relating to the data stream 70, including the syncword 82 used in data streams of the targeted type. Additionally, the matching pattern generator 54 is provided with information related to the anticipated value for at least one header field in a valid header 80 in the target data stream 70. As discussed above, this information may be derived from actually reading a header 80 in the target data stream 70, or it may be derived from separately provided information about the data stream 70. In either case, the matching pattern generator 54 constructs a matching pattern 60 comprising a syncword 62 (which is identical to the syncword 82) and additional bits 64 corresponding to the anticipated value or values for one or more header fields in a valid header 80.

The matching pattern 60 is used by the frame boundary detector 56 to search a portion of the data stream for an instance of the matching pattern 60. Each instance of the matching pattern 60 will usually correspond to a frame boundary 74. In some embodiments of the present invention, the frame boundary detector 74 will stop its search at the first instance of the matching pattern 60, yielding a corresponding detected frame boundary 74. In other embodiments, the frame boundary detector 56 may be configured to continue to search the data stream 70, detecting multiple instances of the matching pattern 60, until it receives a terminating signal from the control logic 52. The detected frame boundary 74 in this example may correspond to the last detected instance of the matching pattern 60 before the terminating signal was received.

Alternatively, as discussed previously, the frame boundary detector 56 may be configured to search the data stream 70 for a pre-determined number of instances of the matching pattern 60; in this case the detected frame boundary 74 may correspond to the last detected instance.

In any event, the frame boundary detector 56 passes information relating to the detected frame boundary 74 to the frame decoder 58. The frame decoder 58 decodes one or more encoded audio frames 72, using an appropriate decoder algorithm. The frame decoder 58 produces a decoded audio output, which may comprise an uncompressed digital audio stream, for example a pulse code modulation (PCM) audio stream, for use by an audio application and/or for conversion into analog audio.

The decoder 50 may interface with a memory 40 to access the data stream 70. The data stream 70 may be organized as a file, and stored in memory 40, in which case the memory 40 may be a random-access memory or nonvolatile storage memory, such as flash memory or a magnetic disk drive. The data stream 70 may also be derived from a streaming audio or multimedia source on a data network, in which case the memory 40 is most likely a random-access memory buffering a portion of the data stream 70.

The control logic block 52, matching pattern generator 54, frame boundary detector 56, and frame decoder 58 may be implemented with digital logic hardware or with software running on a microprocessor, or a combination of both. Any block may be implemented by a dedicated processor, or several blocks may be implemented by a single processor. The frame decoder 58 in particular may be implemented with a specialized digital-signal-processor (DSP), but any of the blocks may be implemented in whole or in part with a general-purpose microprocessor or a DSP. In addition, functionality of any block may be partitioned between two or more processors or hardware blocks without departing from the spirit of this invention.

Those skilled in the art should appreciate that the present invention broadly provides methods and devices for rapidly and effectively detecting frame boundaries in an encoded audio data stream for use in an audio decoder. The present invention may, of course, be carried out in other specific ways than those herein set forth without departing from the scope and essential characteristics of the invention. Thus, the present invention is not limited to the features and advantages detailed in the foregoing description, nor is it limited by the accompanying drawings. Indeed, the present invention is limited only by the following claims, and their legal equivalents.

What is claimed is:

1. A method for decoding encoded audio frames in a data stream, each frame comprising a header, the method comprising the steps of:

generating a matching pattern comprising a syncword and one or more additional bits corresponding to at least one anticipated value for a header field in a valid encoded audio frame;

detecting a frame boundary by searching a portion of the data stream for an instance of the matching pattern; and decoding one or more encoded audio frames beginning at a point in the data stream corresponding to the detected frame boundary.

2. The method of claim 1, wherein detecting a frame boundary comprises searching for a pre-determined number of instances of the matching pattern, and wherein the detected frame boundary corresponds to a last one of said instances.

3. The method of claim 1, further comprising receiving a termination signal, wherein detecting a frame boundary comprises searching a portion of the data stream for instances of the matching pattern until the termination signal is received.

4. The method of claim 3, wherein detecting a frame boundary comprises detecting a frame boundary corresponding to a last instance of the matching pattern detected before the termination signal is received.

5. The method of claim 4, further comprising providing a frame detect signal indicative of a number of detected instances of the matching pattern for use in generating said termination signal.

6. The method of claim 1, wherein the encoded audio frames comprise Advanced Audio Codec raw data blocks.

7. The method of claim 6, wherein the frame headers comprise Audio Data Transport Stream (ADTS) headers.

8. The method of claim 7, wherein the matching pattern comprises a 12-bit syncword and additional bits corresponding to anticipated values for a one-bit ID field, a two-bit layer field, and a one-bit protection absent field.

9. The method of claim 1, further comprising detecting an audio processing error and identifying an error location in the data stream corresponding to said audio processing error; wherein searching a portion of the data stream for an instance of the matching pattern begins at said error location.

10. The method of claim 1, wherein detecting a frame boundary comprises verifying that the detected frame boundary corresponds to a valid header.

11. The method of claim 10, wherein verifying that the detected frame boundary corresponds to a valid header comprises evaluating cyclical redundancy checksum bits to confirm that the detect frame boundary corresponds to a valid header.

12. An audio decoder for decoding encoded audio frames in a data stream, comprising:

a matching pattern generator configured to generate a matching pattern comprising a syncword and one or more additional bits corresponding to at least one anticipated value for a header field in a valid encoded audio frame;

a frame boundary detector configured to search a portion of the data stream for an instance of the matching pattern to detect a frame boundary; and a frame decoder configured to decode one or more encoded audio frames beginning at a point in the data stream corresponding to the detected frame boundary.

13. The audio decoder of claim 12, wherein the frame boundary detector is configured to search for a pre-determined number of instances of the matching pattern, and wherein the detected frame boundary corresponds to a last one of said instances.

14. The audio decoder of claim 12, wherein the frame boundary detector is configured to receive a termination signal, and wherein the frame boundary detector is further configured to search for instances of the matching pattern until the termination signal is received.

15. The audio decoder of claim 14, wherein the detected frame boundary corresponds to a last instance of the matching pattern detected before the termination signal is received.

16. The audio decoder of claim 15, wherein the frame boundary detector is further configured to provide a frame detect signal indicative of a number of detected instances of the matching pattern for use in generating the termination signal.

17. The audio decoder of claim 12, wherein the encoded audio frames comprise Advanced Audio Codec raw data blocks.

18. The audio decoder of claim 17, wherein the encoded audio frames comprise Audio Data Transport (ADTS) headers.

19. The audio decoder of claim 18, wherein the matching pattern generator is configured to generate a matching pattern comprising a 12-bit syncword and additional bits corresponding to anticipated values for a one-bit ID field, a two-bit layer field, and a one-bit protection absent field.

20. The audio decoder of claim 12, further comprising a decode error detector configured to detect an audio processing error and to identify an error location in the data stream corresponding to said audio processing error; wherein the frame boundary detector is further configured to begin searching at said error location.

21. The audio decoder of claim 12, wherein the frame boundary detector is further configured to verify that the detected frame boundary corresponds to a valid header.

22. The audio decoder of claim 21, wherein the frame boundary detector is configured to verify that the detected frame boundary corresponds to a valid header by evaluating cyclical redundancy checksum bits in the data stream to confirm that the detected frame boundary corresponds to a valid header.

* * * * *